US006749456B1

(12) United States Patent
Conner et al.

(10) Patent No.: US 6,749,456 B1
(45) Date of Patent: Jun. 15, 2004

(54) INSULATION PIERCING CONNECTOR

(75) Inventors: Abe A. Conner, Garden City, MI (US); Paul R. Strouse, Leslie, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/441,579

(22) Filed: May 20, 2003

(51) Int. Cl.[7] ..... H01R 11/20

(52) U.S. Cl. ..... 439/410; 439/404; 439/417; 439/422

(58) Field of Search ..... 439/404, 410, 439/417, 422

(56) References Cited

U.S. PATENT DOCUMENTS 3,835,445 A * 9/1974 Hardesty ..... 439/410
3,851,945 A * 12/1974 Collier ..... 439/410
4,944,696 A 7/1990 Sueyoshi et al. ..... 439/595
5,842,893 A 12/1998 De Keyser ..... 439/783
5,916,001 A 6/1999 Chadbourne ..... 439/783
6,109,973 A 8/2000 Gronowicz, Jr. et al. ... 439/620
6,152,786 A 11/2000 Perrin et al. ..... 439/783
6,250,959 B1 * 6/2001 Yamaguchi et al. ..... 439/578
6,273,765 B1 8/2001 Lalaouna et al. ..... 439/784
6,443,758 B2 * 9/2002 Nagai ..... 439/465

* cited by examiner

*Primary Examiner*—Truc Nguyen
(74) *Attorney, Agent, or Firm*—Young & Basile P.C.

(57) ABSTRACT

An electrical connector includes a housing having at least one wire insertion channel for electrical wires to be inserted therein. An upper terminal in the channel has a sharp edge for piercing into the insulation of each wire and electrically contacting the conductive element of the wire. At least one lower terminal in the channel has a blunt edged element for supporting the insulated wire as the upper terminal pierces the insulation of the insulated wire. An actuator is operable for inserting into the connector and actuating a hinged plane causing the upper terminal to piercingly engage the insulated wire and make electrical contact with the conductive element of the wire.

23 Claims, 3 Drawing Sheets

INSULATION PIERCING CONNECTOR

FIELD OF THE INVENTION

This invention relates to a connector for insulated electrical wires, and more particularly to an insulation displacement connector utilizing an actuator for driving a sharp edged terminal through the insulation for making electrical contact with the conductive portion of the wire.

BACKGROUND OF THE INVENTION

Prior art connectors utilize various methods to make electrical connections with insulated wires. Typically, it is necessary to strip the insulation from a short length of wire using a knife or a special tool. It is also known to make electrical connections to insulation covered wires by piercing the wires with a sharp conductive terminal device.

SUMMARY OF THE INVENTION

An electrical connector of the type which provides electrical contact between an insulated wire and a conductive terminal by piercing the insulation and without the necessity for stripping the wire. In general, the invention comprises a terminal housing including normally spaced apart complemental piercing terminals between which a wire is placed. The invention further comprises an actuator member which is pushed into the housing to progressively urge the piercing terminals toward one another, piercing the insulation on one or more wires placed between them.

In an illustrative embodiment, the housing includes at least multiple wire insertion channels and an actuator insertion channel. The actuator insertion channel is positioned adjacent the wire insertion channels. The wire insertion channels have an upper wall which is fixed and a lower wall which lies between the wire insertion channels and the actuator insertion channel. A first portion of the lower wall is fixed and a second portion of the lower wall is moveable between a first position more spaced from the upper wall and a second position less spaced from the upper wall.

Upper terminals having a sharp edged element are mounted on the upper wall and operable for piercing insulated wires. Complimentary terminals are mounted on the lower wall. The lower terminals have blunt edged elements for supporting the insulated wires as the upper terminals pierce into the insulation of the wires to electrically contact a conductive element of each wire. An actuator member is inserted into the actuator insertion channel causing the second portion of the lower wall to move from the first position to the second position bringing the terminals together and piercing the wires.

In operation, the actuator displacement connector facilitates electrical contact between one or more insulated wires and one or more conductive terminals without the necessity of first stripping insulation from the wires. The insulated electrical wires are inserted into wire insertion channels located in the housing of the actuator displacement connector until a mechanical stop limits further ingress of the wire into the channel. An actuator member is inserted into the housing for urging the lower wall of the wire insertion channel progressively toward the upper wall causing the insulation of the wire to be pierced by the upper terminal. The actuator is removably locked into the connector via a snap member to ensure the wires remain positively engaged with the connector.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
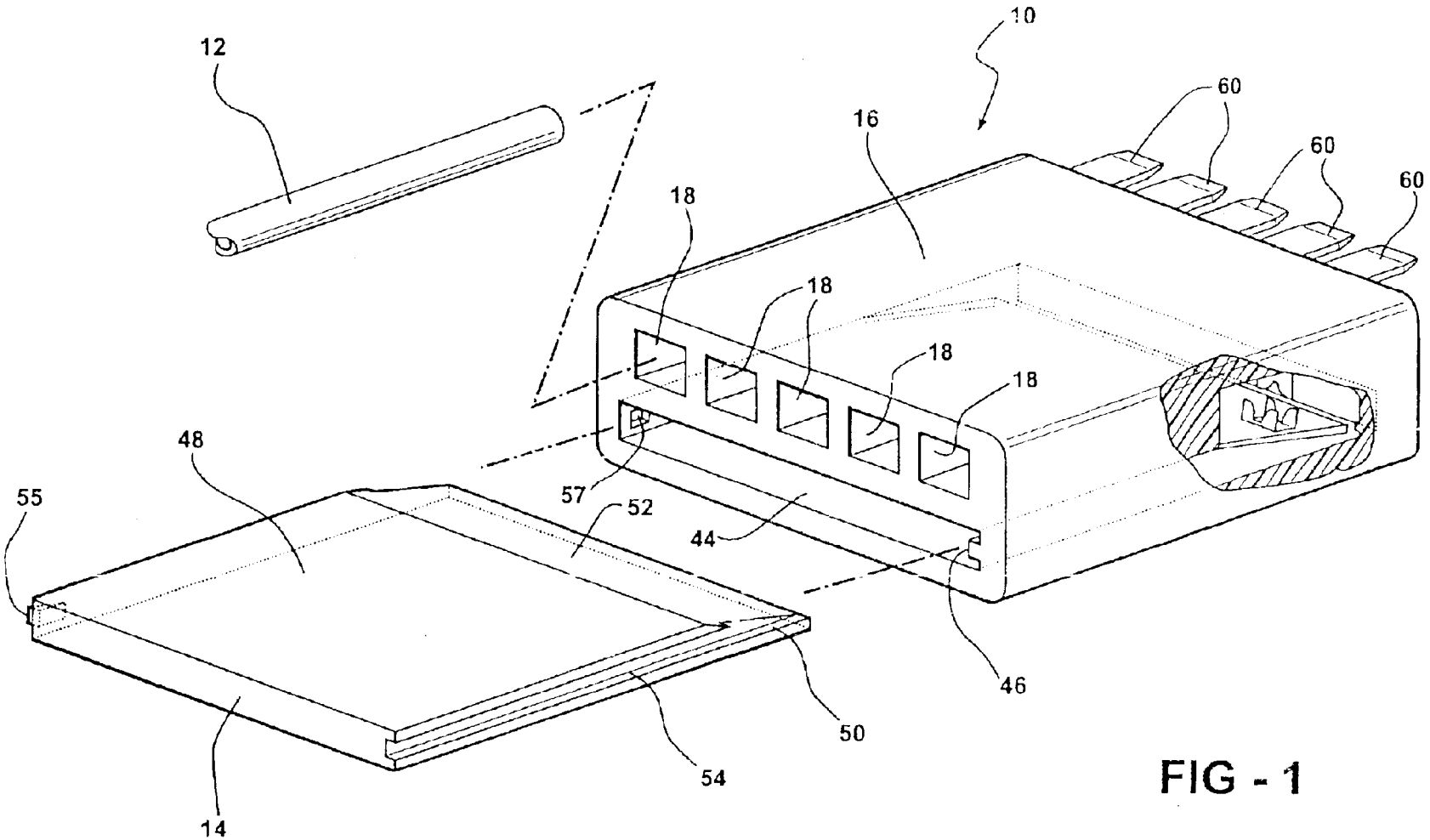
FIG. 1 is a perspective view of an actuator displacement connector, an insulated wire, and an actuator.
Figure 2:
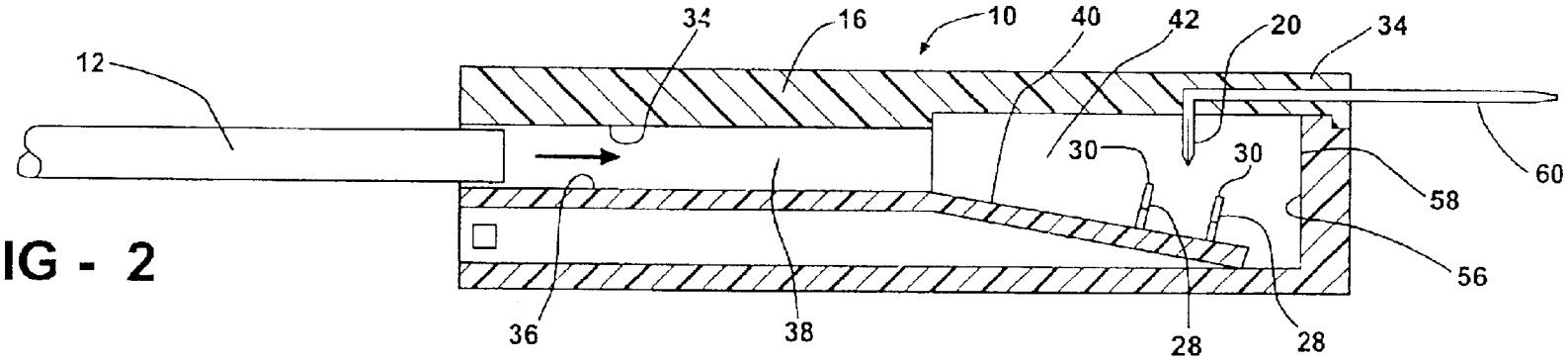
FIG. 2 is a cross-sectional view of the connector showing the wire entering a wire insertion channel.
Figure 3:
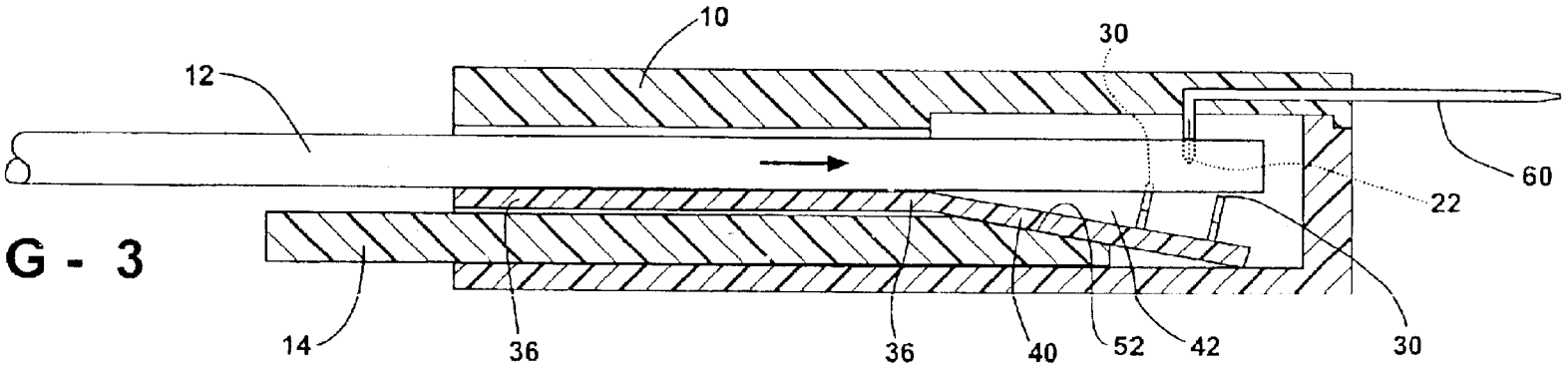
FIG. 3 is a cross-sectional view of the connector showing the wire fully inserted into the wire insertion channel and an actuator positioned in a first portion of an actuator insertion channel.
Figure 4:
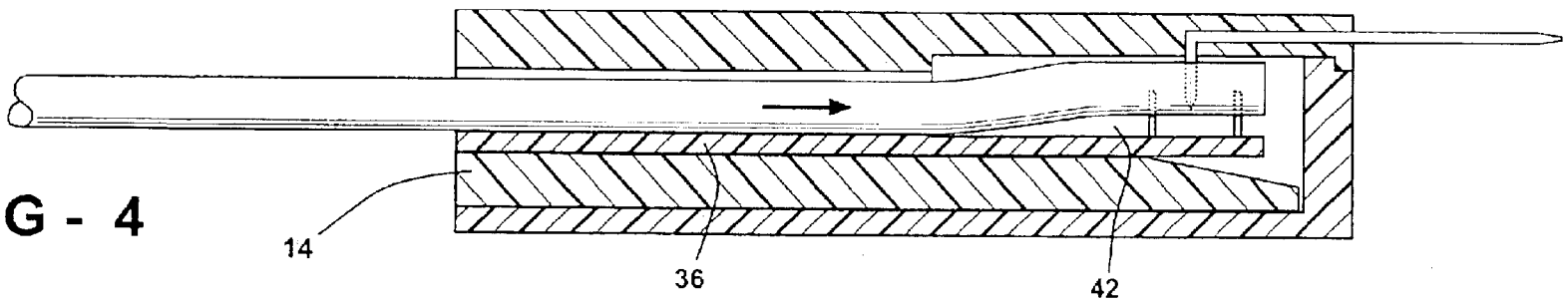
FIG. 4 is a cross-sectional view of the connector showing the actuator fully inserted and an upper terminal piercingly engaging the insulated wire as a second and third terminal supports the insulated wire.

Referring generally to FIG. 1, an electrical connector 10 is shown with an insulated electrical wire 12 and an actuator 14 removed from the connector 10. Referring to FIGS. 1 through 6, the electrical connector 10 includes a housing 16 having a plurality of wire insertion channels 18 for the insulated electrical wires 12 to be inserted therein. An upper terminal 20 having a sharp edged element 22 is operable for piercing the insulation 24 of an insulated electrical wire 12 and electrically contacting the conductive element 26 of the wire 12 (best seen in FIGS. 5 and 6). A pair of lower terminals 28 have blunt edges 30 for supporting the wire 12 such that the upper terminal 28 can pierce the insulation 24 of the wire 12.

The wire insertion channels 18 include substantially parallel upper 34 and lower 36 walls along a first portion 38 thereof. A hinged plane 40 defines the lower wall 36 along a second portion 42 of the channels 18. The upper terminal 20 is operably supported by the upper wall 34 of the channels 18 and the lower terminals 28 are operably supported by the hinged plane 40. The connector housing 16 has an actuator insertion channel 44 defined by a substantially rectangular slot located below the lower wall 36 of the wire insertion channels 18 (best seen in FIG. 1). The slot 44 has a protruding tongue 46 formed along one side thereof.

An actuator 14 is inserted into the slot 44 of the connector 10 for contacting the hinged plane 40. The actuator 14 can be urged forward to displace the hinged plane 40 and causing the wire 12 to engage the first piercing terminal 20. The actuator 14 is substantially rectangular in shape along the first portion 48 and is tapered along a second portion 50. The tapered end 50 enters the housing 16 such that a ramp 52 formed by the tapered end 50 will contact the hinged plane 40 and move the hinged plane 40 upward along the ramp 52 as the actuator 14 slides into the connector 10. The actuator has a groove 54 formed into the side thereof for slidingly engaging the tongue 46 of the slot 44. The tongue 46 and groove 54 connection ensures the actuator 14 is inserted into the connector 16 in the correct orientation. A mechanical stop 56 (best seen in FIG. 2) is located in the housing 16 for defining the length of wire that projects into the wire insertion channel 18. The mechanical stop 56 can be any impediment to the progression of the wire 12 including, but not limited to, the end wall 58 of the housing 16.

Figure 6:
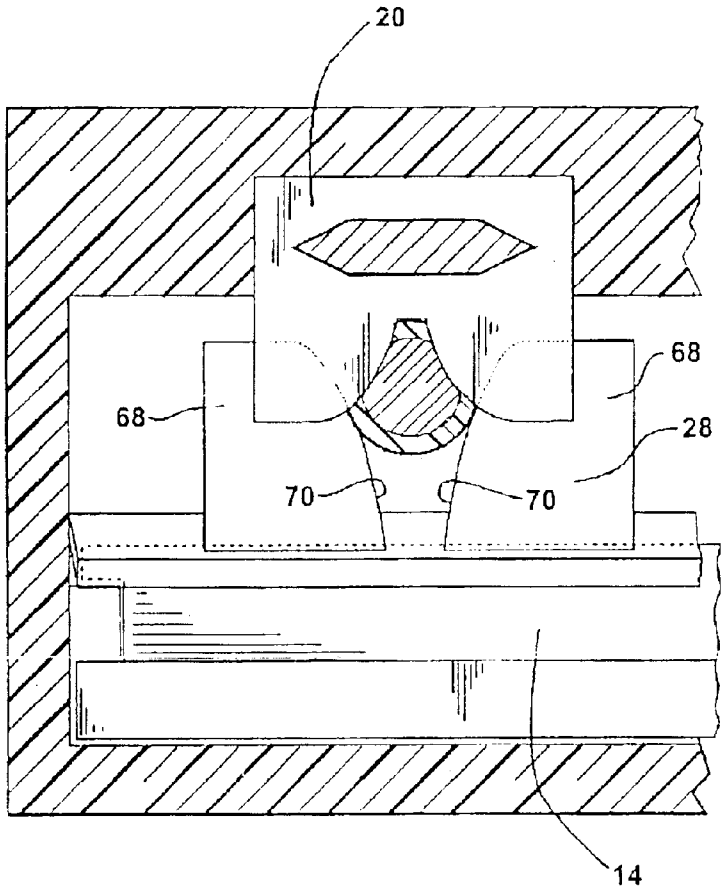
FIG. 6 is a partial cross-sectional end view of the connector showing the upper terminal in piercing contact with the insulated wire and the second terminal in supporting contact with the insulated wire.
Figure 5:
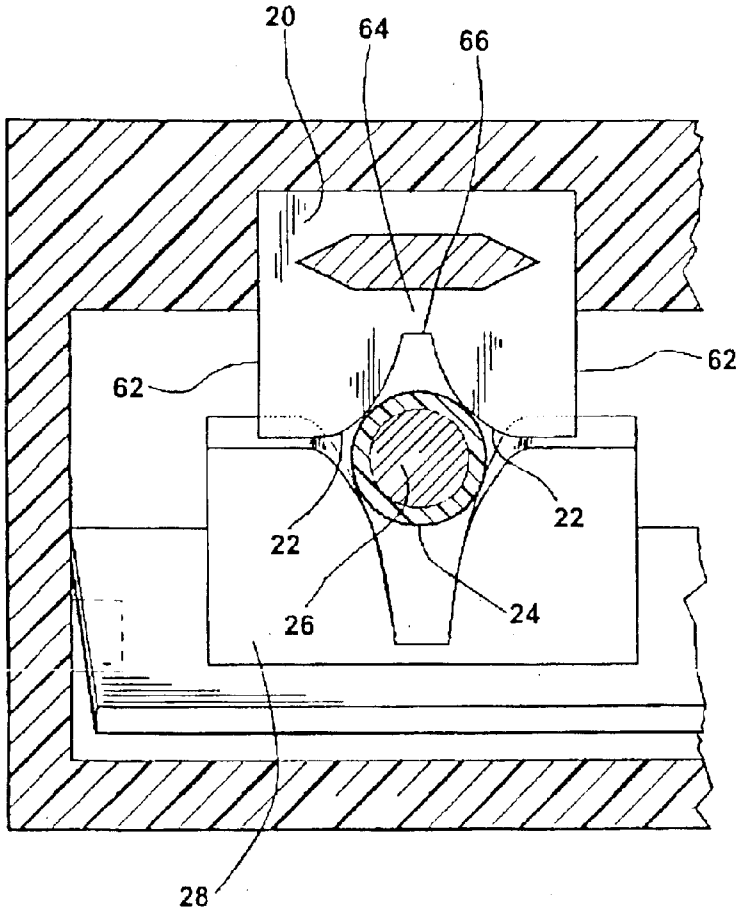
FIG. 5 is a partial cross-sectional end view of the connector showing the first and second terminals contacting the insulated wire.

Referring now more particularly to FIGS. 5 and 6, the sharp edge 22 of the upper terminal 20 has a substantially convex curved shape extending from each side 62 of the terminal 20 towards the center 64 thereof. The edge 22 terminates at a substantially horizontal linear portion 66 located in an intermediate position of the terminal 20. The lower terminals 28 are positioned on either side of the upper terminal 20 such that the piercing action is similar to a guillotine in that the insulated wire 12 is prevented from moving out of position when the first piercing terminal 20 engages the insulated wire 12. The second and third terminals 28 include a pair of elements 68 having blunt edges 70 for supporting the wire 12 without cutting into the insulation 24.

The connector housing 16 can be formed of any non-conducting material including, but not limited to, a plastic material. The upper and lower terminals 20, 28 can be integrally molded into the housing forming a permanent connection therein. The first piercing terminal 20 is electrically connected with a conducting prong 60 that extends out of the housing 16 for electrically connecting with a separate apparatus (not shown).

In operation, the electrical connector 10 connects to an insulated wire 12 in a unique manner. A wire 12 is inserted into a wire insertion channel 18 of the connector 10 until the wire contacts a mechanical stop. When the wire hits the mechanical stop 56, the wire 12 is correctly positioned in the wire insertion channel 18. The actuator 14 is then inserted into the connector 10 which causes the hinged plane 40 to move upward toward the insulated wire 12. The wire 12 is first contacted with the lower terminals 28 from the bottom of the connector 10. As the actuator 14 continues to be inserted into the actuator insertion channel 44, the hinged plane 40 continues to move upward. The hinged plane 40 forces the wire 12 towards the upper terminal 20 located on the upper wall 34 near the top of the connector 10. The sharp edge 22 of the upper terminal 20 pierces the insulation 24 and contacts the conductive element 26 causing electrical communication between the upper terminal 20 and the conductive element 26 of the wire 12. The actuator 14 is removably locked into the connector 10 with a snap-lock 55 that engages an aperture 57 in the housing as shown in FIG. 1. The upper bladed terminal 20 includes a prong 60 extending away from the upper terminal 20 and out of the connector housing 16. The conducting prongs 60 can then be connected to a separate apparatus (not shown) such as a second electrical wire or other electrical components.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An electrical connector of the type which provides electrical contact between an insulated wire and a conductive terminal without the necessity for stripping the wire comprising:

a housing defining a wire insertion channel and an actuator insertion channel adjacent the wire insertion channel, the wire insertion channel having an upper wall which is fixed and a lower wall which lies between the wire insertion channel and the actuator insertion channel, a first portion of the lower wall is fixed and a second portion of the lower wall is moveable between a first position more spaced from the upper wall and a second position less spaced from the upper wall;

an upper terminal, mounted on the upper wall, having a sharp edged element for piercing the insulated wire;

at least one lower terminal mounted on the lower wall, complemental to the upper terminal for supporting the insulated wire as the upper terminal pierces into the insulation of the wire and electrically contacts a conductive element of the wire; and an actuator member insertable into the actuator insertion channel for causing movement of second portion of the lower wall from the first position to the second position.

2. The electrical connector of claim 1 further comprising:

additional wire insertion channels sharing the upper and lower walls; additional upper terminals having piercing elements mounted on the upper wall; and additional lower terminals having blunt edged elements mounted on the lower wall, the upper and lower terminals in registry with respective wire insertion channels.

3. The electrical connector of claim 1, wherein the second portion of the lower wall is defined by a hinged plane.

4. The electrical connector of claim 1, wherein the actuator insertion channel further comprises:

a substantially rectangular slot located below the lower wall of the wire insertion channels, the slot having a protruding tongue formed along one side thereof; and an actuator locking aperture located on a side of the slot opposite the tongue.

5. The electrical connector of claim 4, wherein the actuator has a groove formed into the side thereof for slidingly engaging the tongue of the slot.

6. The electrical connector of claim 4, wherein the actuator has a snap lock element for releasably snap-locking into the locking aperture of the actuator insertion channel.

7. The electrical connector of claim 1, wherein the actuator includes first and second ends, the actuator being substantially rectangular in shape at the first end and tapered at the second end.

8. The electrical connector of claim 1 further comprising:

a mechanical stop located in the housing for defining a length of wire positioned inside the wire insertion channel.

9. The electrical connector assembly of claim 8, wherein the mechanical stop is an end wall of the housing.

10. The electrical connector assembly of claim 1 further comprising:

an electrically conducting prong having first and second ends, the first end of the prong connecting to the upper terminal and the second end of the prong extending out of the housing for electrically connecting with an electrical apparatus.

11. The electrical connector of claim 1, wherein the piercing element of the upper terminal includes a substantially convex curved shape extending from each side of the terminal towards the center thereof, the element terminating at a substantially horizontal linear portion located at an intermediate position relative to the sides of the terminal.

12. The electrical connector of claim 1, wherein the housing is formed of plastic material.

13. The electrical connector of claim 12, wherein the terminals are integrally molded into the housing.

14. An electrical connector of the type which provides electrical contact between an insulated wire and a conductive terminal without the necessity for stripping the wire comprising:

a housing defining a wire insertion channel and an actuator insertion channel adjacent said wire insertion channel, said wire insertion channel having an upper wall which is fixed and a lower wall which lies between the wire insertion channel and the actuator insertion channel, a first portion of the lower wall is fixed and a second portion the lower wall is moveable between a first position more spaced from the upper wall and a second position less spaced from the upper wall;

an upper terminal, mounted on the upper wall, having a sharp edged element for piercing the insulated wire;

a pair of lower terminals mounted on the lower wall for supporting the insulated wire as the upper terminal pierces into the insulation of each wire for electrically contacting a conductive element of the wire; and means insertable into the housing for causing the upper and lower terminals to be displaced toward one another.

15. The electrical connector of claim 14 wherein said means for causing comprises:

an actuator member insertable into the actuator insertion channel for causing movement of the second portion of the lower wall from the first position to the second position.

16. The electrical connector of claim 15, wherein the actuator includes first and second ends, the actuator being substantially rectangular in shape at the first end and tapered at the second end.

17. The electrical connector of claim 14 further comprising:

additional wire insertion channels sharing the upper and lower walls; and additional upper terminals having sharp edged elements mounted on the upper wall;

additional lower terminals having blunt edged elements mounted on the lower wall; and the upper and lower terminals in registry with respective wire insertion channels.

18. The electrical connector of claim 14, wherein the second portion of the lower wall is defined by a hinged plane.

19. The electrical connector of claim 14, wherein the actuator insertion channel further comprises:

a substantially rectangular slot located below the lower wall of the wire insertion channels, the slot having a protruding tongue formed along one side thereof; and an actuator locking aperture located on a side of the slot opposite the tongue.

20. The electrical connector of claim 19, wherein the actuator has a groove formed into the side thereof for slidingly engaging the tongue of the slot.

21. The electrical connector of claim 19, wherein the actuator has a snap lock element for releasably snap-locking into the locking aperture of the actuator insertion channel.

22. A method of making electrical contact between an insulated wire and a conductive terminal without the necessity of stripping the wire comprising the steps of:

providing a connector housing having an insertion channel for the wire with a fixed upper wall and a movable lower wall;

providing complemental and registered piercing elements on the upper and lower walls at an end of the insertion channel, the upper element being integral with said terminal;

inserting a wire into the wire insertion channel so as to be disposed in part between said elements; and urging a displacement member into contact with the lower wall to urge it progressively toward the upper wall to close the elements and pierce the insulation on the wire.

23. The method of claim 22, further compromising the step of:

removably locking the actuator into the connector.

* * * * *